US009016844B2

(12) United States Patent
Morgan et al.

(10) Patent No.: US 9,016,844 B2
(45) Date of Patent: Apr. 28, 2015

(54) INKJET PRINTERS

(75) Inventors: Jonathan Morgan, Cambridge (GB); Stuart Mark Walkington, St. Albans (GB); Christopher Hall, Chatteris (GB)

(73) Assignee: Domino Printing Sciences PLC (GB)

( * ) Notice: Subject to any disclaimer, the term of this patent is extended or adjusted under 35 U.S.C. 154(b) by 0 days.

(21) Appl. No.: 13/885,215

(22) PCT Filed: Nov. 21, 2011

(86) PCT No.: PCT/GB2011/052278

§ 371 (c)(1),
(2), (4) Date: Jul. 12, 2013

(87) PCT Pub. No.: WO2012/066359

PCT Pub. Date: May 24, 2012

(65) Prior Publication Data

US 2013/0286115 A1 Oct. 31, 2013

(30) Foreign Application Priority Data

Nov. 19, 2010 (GB) ..... 1019682.2

(51) Int. Cl.

| | |
|---|---|
| ***B41J 2/19*** | (2006.01) |
| ***B41J 2/18*** | (2006.01) |
| ***B41J 2/175*** | (2006.01) |
| ***B41J 2/185*** | (2006.01) |

(52) U.S. Cl.

CPC .. *B41J 2/18* (2013.01); *B41J 2/175* (2013.01); *B41J 2/185* (2013.01)

(58) Field of Classification Search

USPC ..... 347/7, 85, 89, 92

See application file for complete search history.

(56) References Cited

U.S. PATENT DOCUMENTS

| | | | | |
|---|---|---|---|---|
| 3,929,071 | A | 12/1975 | Cialone et al. | |
| 5,182,581 | A | 1/1993 | Kashimura et al. | |
| 5,936,650 | A * | 8/1999 | Ouchida et al. | 347/89 |
| 6,234,621 | B1 | 5/2001 | Musser et al. | |
| 6,257,712 | B1 | 7/2001 | Haigo | |
| 6,955,425 | B2 * | 10/2005 | Childs et al. | 347/89 |
| 8,162,451 | B2 * | 4/2012 | Saga et al. | 347/85 |

FOREIGN PATENT DOCUMENTS

| | | |
|---|---|---|
| EP | 1359026 | 11/2003 |
| EP | 1232870 | 9/2004 |
| EP | 1707377 | 4/2010 |
| JP | 9-29998 | 2/1997 |

OTHER PUBLICATIONS

US Patent Pub. No. 2010/0238239A1, Sep. 23, 2010, Shinkai.
US Patent Pub. No. 2010/0053279A1, Mar. 4, 2010, Tamaki.

* cited by examiner

*Primary Examiner* — Anh T.N. Vo
(74) *Attorney, Agent, or Firm* — Price Heneveld LLP

(57) ABSTRACT

Method and Apparatus for Reducing Ink Foaming in a Continuous Inkjet Printer The invention provides a method of and apparatus for reducing foam formation in the returned ink in a continuous inkjet printer. The returned ink is subjected to deceleration and is reduced in pressure, preferably by being directed into a sub-chamber which reverses the direction of flow and provides an elevated edge over which the ink overflows. The de-aeration facility is preferably incorporated in an ink service module.

15 Claims, 3 Drawing Sheets

INKJET PRINTERS

FIELD OF THE INVENTION

This invention relates to inkjet printers and, more particularly, to a method of and/or means for reducing, or reducing the effects of, foam formation in a continuous inkjet (CIJ) printer.

BACKGROUND TO THE INVENTION

Continuous ink jet printing involves the formation of electrically charged drops from a jet of ink, and the subsequent deflection of the charged drops by an electric field to produce an image on a print medium.

In a typical embodiment of a single-jet CIJ printer, electrically conducting ink is forced through a nozzle by applying pressure to the ink. The velocity of the resulting jet of ink must be controlled. This is commonly effected by controlling the constituency of the ink in conjunction with controlling the pressure. Pressure control is usually achieved by varying the speed of the pump producing the flow in response to feedback from a pressure transducer, but it may also be achieved using feedback from a velocity measurement device.

A controlled sequence of drops, each with identical drop volumes and with constant separation between adjacent drops, can then be formed by modulating the jet to give active and controlled drive to the natural process of jet break-up. Jet break-up is usually achieved by carefully modulating the ink pressure, in a sinusoidal manner, at fixed frequency and amplitude; or by modulating the ink velocity relative to the nozzle. A range of options and techniques to introduce pressure modulation, velocity modulation or a combination of both so that uniform drop sequences are obtained are well known in the art.

Charge is induced on individual drops through capacitive coupling. Desired levels of charge are induced on drops by applying a voltage to the charge electrodes at the time the drop separates from the jet. After charging, the drops travel through a constant electric field, formed by applying a high potential difference between two surfaces, whose field lines are perpendicular to trajectory of the jet. Charged drops are deflected by an amount that approximately scales with the charge on the drops.

Un-charged or non-printing drops are collected by a gutter incorporated in the print head, and returned to an ink reservoir in the printer for ink re-flow and re-use.

A significant factor in the reliable operation of a continuous inkjet printer is ensuring that the gutter is capable of collecting all of the non-printing ink drops and that the collected ink is transported back to the ink reservoir.

Typically a continuous ink jet has a relatively small print head that is attached to the printer's ink supply system, reservoir and control electronics via a conduit that is several meters long. The removal of ink collected in the gutter is achieved by drawing the ink, along with air, through a return pipe located in the conduit. This is effected using a vacuum pump.

A number of pumping technologies may used to remove the ink from the gutter. Jet pumps are ideally suited to clearing gas and air mixtures, and produce a uniform and predictable vacuum that efficiently pulls air and ink through the gutter. Jet pump action relies upon turbulence in a pump chamber between a nozzle and a throat in order to work effectively. This pump action has the effect of mixing air and ink efficiently as a by-product of the turbulence that is created to provide the vacuum. Thus, although a jet pump is able to remove ink from the print head effectively, an undesirable consequence is that a large amount of air is trapped in the ink. The air-laden ink will attempt to release air when the ink is returned to the ink reservoir, as the ink is stored at atmospheric pressure rather than at the higher pressure experienced in the return pipe.

The release of air from the air-laden ink in the reservoir often results in the formation of foam, which can cause the ink to overflow from the ink reservoir container. Another problem associated with air-laden ink is that the air can be released from the ink when it is re-circulated through the print head. Such release of air bubbles within the ink system can result in undesirable pressure fluctuations that compromise the subsequent production of droplets.

There are many examples in the art of attempts to reduce the tendency of returned ink to form foams. The extent to which a stable foam forms depends on many factors such as the surface tension of the ink, the partial pressure of solvent vapour present in the reservoir and the rate at which air is released from the ink. Some manufacturers add anti-foaming agents such as surfactants to the ink to reduce foam formation, but this is not preferred as it may affect the adhesion and surface wetting properties of the ink. One example of a physical arrangement to reduce the formation of foam in ink is described in U.S. Pat. No. 6,234,621. This patent describes the returned ink being feed back into the top of an ink reservoir and onto a downwardly spiralling ramp located with within the reservoir. As the ink flows down the ramp its velocity is reduced, the ink spreads out across the ramp surfaces and entrained air is said to be expelled from the ink before the ink added to the upper surface of the ink in the reservoir. This arrangement is expensive to implement and the ramp occupies a significant space within the reservoir.

One alternative arrangement for reducing entrained air in the ink is described in JP9029998 in which the returning air with entrained air is directed onto the upper surface of a sub-chamber. Ink to be returned to the print head is then withdrawn from the base of the sub-chamber. Whilst this arrangement will reduce the amount of air entrained within the ink supplied to the print head, nothing is done to reduce the velocity of the returning ink and thus foam formation and air entrapment is high.

It is an object of this invention to provide a continuous inkjet printer, and/or one or more methods and components therefor, which will go at least some way in addressing aforementioned problems; or which will at least provide a novel and useful choice.

SUMMARY OF THE INVENTION

Accordingly, in one aspect, the invention provides a method of reducing foam formation in returned ink in a continuous inkjet printer, said printer having a returned ink receiving chamber; a returned ink delivery discharging into said chamber; and an ink pick-up leading from said chamber, said method being characterised in that it includes slowing the flow rate of returning ink by locating said returned ink delivery in a sub-chamber located within said chamber, wherein ink is fed into a lower region of said sub-chamber beneath a surface of ink in said sub-chamber and the ink surface in said sub-chamber is caused to rise and to overflow into said chamber.

Preferably said method comprises slowing the rate of pressure change of said returned ink.

Preferably said method includes reversing the direction of flow of the returned ink.

Preferably said sub-chamber is substantially cylindrical in cross section, said method comprising directing the returning ink downwardly into said sub-chamber in a direction substantially parallel to the axis of said sub-chamber.

Preferably the method comprises directing the overflowing ink from said sub-chamber on to a perforated surface.

Preferably the method comprises allowing the volume of ink within said sub-chamber to expand radially before overflowing into said receiving chamber.

Preferably said method is effected in a module located between, but detachable from, a print head and an ink circulation system.

In a second aspect of the invention provides a continuous ink jet printer having a returned ink receiving chamber; a returned ink delivery discharging into said chamber; and an ink pickup leading from said receiving chamber, said printer being characterised in that said returned ink delivery is positioned in a lower region of a sub-chamber located within said receiving chamber such that, in use, ink discharged from said ink delivery enters said sub-chamber below an ink surface therein, and wherein a rising ink surface in said sub-chamber can overflow into said receiving chamber.

Preferably said returned ink delivery facility is configured to reduce the rate of pressure change of the returned ink.

Preferably said returned ink facility is constructed and arranged to reverse the direction of flow of the returning ink.

Preferably said sub-chamber is cylindrical in cross section and said return pipe is aligned substantially parallel to the axis of said sub-chamber.

Preferably said returned ink facility further includes a perforated surface positioned to contact ink overflowing from said sub-chamber.

Preferably said sub-chamber expands radially adjacent the upper end thereof.

Preferably said returned ink facility is included in a module located between, but detachable from, a print head and an ink circulation system.

In a third aspect the invention provides a service module for a continuous inkjet printer having an ink circulation system and a print head, said service module including an ink receiving chamber; a returned ink delivery engageable with an ink return line from said print head; and an ink pick-up engageable with a pump supplying ink to said ink circulation system, said service module being characterised in that said returned ink delivery is positioned within a sub-chamber located within said ink receiving chamber wherein, in use, ink enters said sub-chamber beneath an ink surface therein and wherein a rising ink surface in said sub-chamber can overflow into said ink receiving chamber.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The various aspects of the invention will now be described with reference to the accompanying drawings in which.

DETAILED DESCRIPTION OF WORKING EMBODIMENT

The invention described herein has been devised to provide a method of and/or means for reducing foam formation in ink returned from the print head gutter to the ink reservoir of a continuous inkjet printer. A further objective is to ensure that such foam that does form in the returned ink settles on top of the body of ink in the reservoir. Thus ink can be drawn from the base of the reservoir which is substantially free of air.

Air-laden ink from the gutter is directed through an ink return line from the print head into a returned ink receiving chamber, or reservoir, from a returned ink delivery facility which discharges into the chamber. An ink pick-up leads from the chamber to re-circulate the ink back to the ink circulation system of the printer. The characterising feature is that the ink returning from the print head is slowed, and its pressure reduced, prior to entry of the returning ink into the receiving chamber. More particularly, the rate of pressure change is controlled and slowed. This allows the air-laden ink to give up entrapped air more effectively, and thereby reduces the tendency of the ink to form a foam which can be picked up from the chamber and returned to the ink supply circuit of the printer. Further, by discharging the ink into the reservoir at a height substantially above the entry to the pick-up, and in particular above the in surface in the reservoir, any foam that does form settles on the upper surface of the ink and is not drawn back into the ink circulation system.

Figure 1:
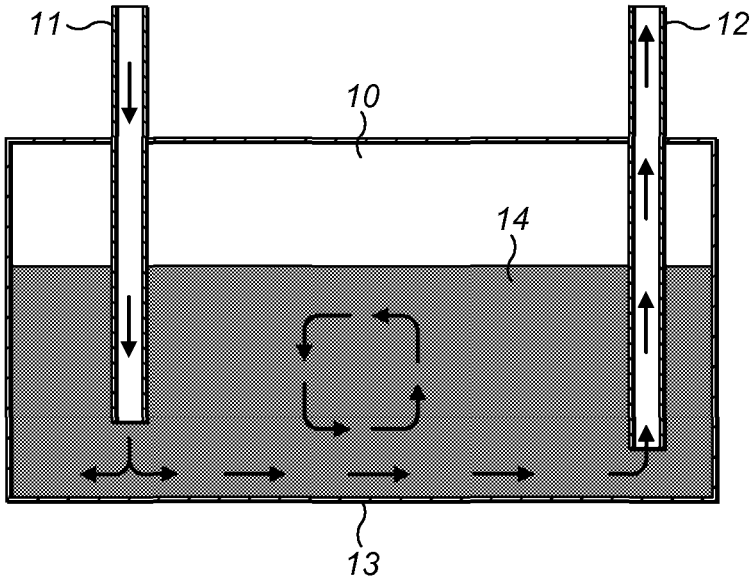
FIG. 1 (Prior art)
FIG. 1: shows a schematic cross-section of a prior art ink return ink system

Referring firstly to FIG. 1, a typical prior art chamber 10 is depicted for receiving ink from the print head gutter (not shown) of a continuous ink jet printer. An ink return line 11 in communication with the print head gutter extends vertically down into the chamber 10 whilst a pick-up line 12 projects upwardly out of the chamber 10 to return the ink to the printer's ink circulation system. Both the return line 11 and the pick-up line 12 have openings adjacent to the base 13 of the chamber 10. As can be seen, air-laden ink issues from the bottom of the return line 11 and merges into the body of ink 14 contained in the chamber 10. Given that the main system pressure is about 3 bar, the ink returning to chamber 10 has a high degree of turbulence and this air-laden ink readily mixes with the ink 14 in the chamber which encourages the formation of foam. Further, the turbulence spreads across the chamber 10 causing air entrained in the ink to be drawn into pick-up line 12.

Figure 2:
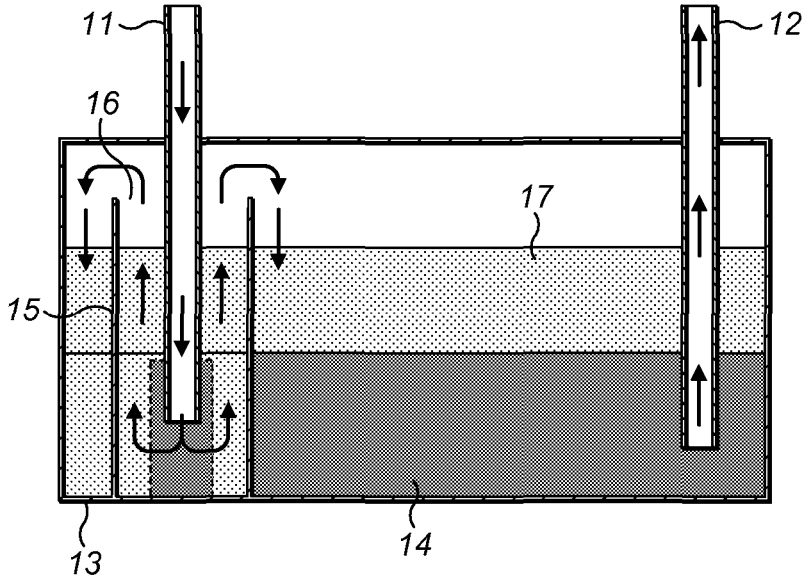
FIG. 2: shows a schematic cross-section of a first embodiment of ink return system according to the invention.

Referring now to FIG. 2, the present invention seeks to address the problems inherent in the arrangement shown in FIG. 1 by slowing the ink passing through the return line 11, and reducing the pressure thereof in a managed way. In the embodiment shown in FIG. 2 this is effected by directing the return line 11 into the lower region of a sub-chamber 15. The sub-chamber 15 is preferably a cylinder open at its upper end 16. The cylinder 15 preferably shares a common base 13 with the chamber 10. It will be appreciated that, as air-laden ink enters the sub-chamber 15 from the return line 11, the flow direction of the ink is reversed and this ink wells up in the sub-chamber 15. As it does so the velocity of the returning ink is reduced as is the pressure thereof. Further, the upper surface of the ink within the sub-chamber 15 provides a release surface which encourages the release of air within the ink. As the returning ink reaches the upper open end 16 of the sub chamber 15 it can overflow the edge of the sub chamber and into the main chamber team 10. This heavier ink passing from sub-chamber 15 passes under gravity to the bottom of chamber 10 and covers the lower open end of the pick-up tube 12. Thus ink drawn through the pick-up tube will be substantially free of air. Any foam which does remain, being lighter, forms a layer 17 on top of the ink and is thus kept away from the pick-up tube 12.

Figure 3:
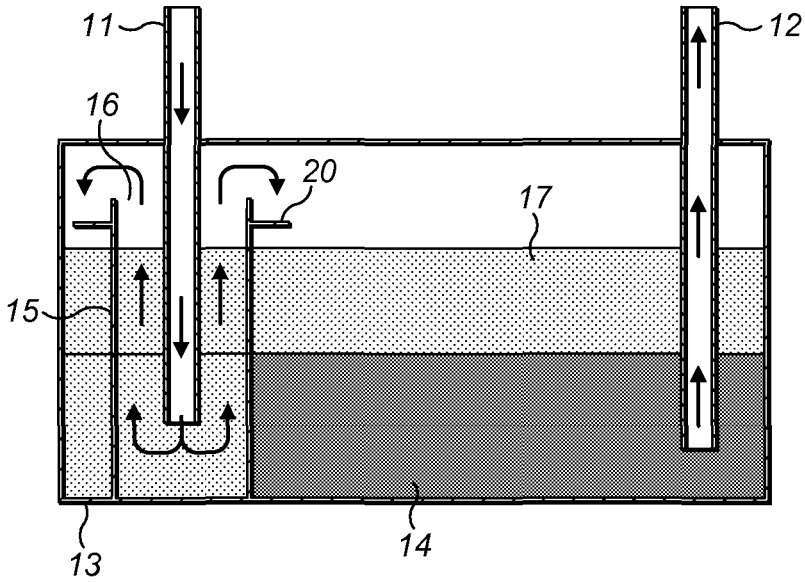
FIG. 3: shows a schematic cross-section of a second embodiment of ink return system according to the invention.

Referring now to FIG. 3, an alternative embodiment is shown in which the ink over flowing from the sub-chamber 15 is directed on to a gauze-like or perforated surface 20 extending from the outer surface of the sub chamber 15. This perforated surface 20 further slows ink spilling from the sub-chamber 15 and provides a surface area from which any air remaining in the ink can separate out from the ink and thus foam formation is reduced. Whilst the perforated surface 20 is shown in the form of an annular attachment to the outer surface of the sub-chamber 15, it could be configured to overlie a greater area of the chamber 10.

Figure 4:
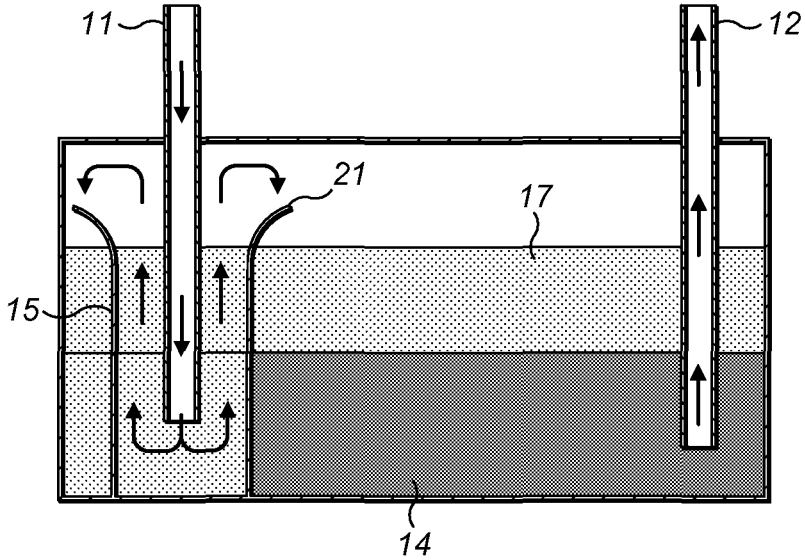
FIG. 4: shows a schematic cross-section of a third embodiment of ink return system according to the invention.

FIG. 4 shows yet a further alternative embodiment of the invention. In this embodiment the transition of the ink between the sub-chamber 15 and the main chamber 10 is further decelerated by increasing the diameter of the upper end of the cylindrical sub-chamber 15 as shown at 21. This embodiment reduces the tendency of the ink to foam by reducing the flow rate of ink in a more graduated step, whilst increasing the surface area of ink in contact with the vapour contained in the ink reservoir, making it energetically more favourable for the air to be separated from the ink.

It will be appreciated that the features of the two embodiments shown respectively in FIGS. 3 and 4, could be combined.

Figure 5:
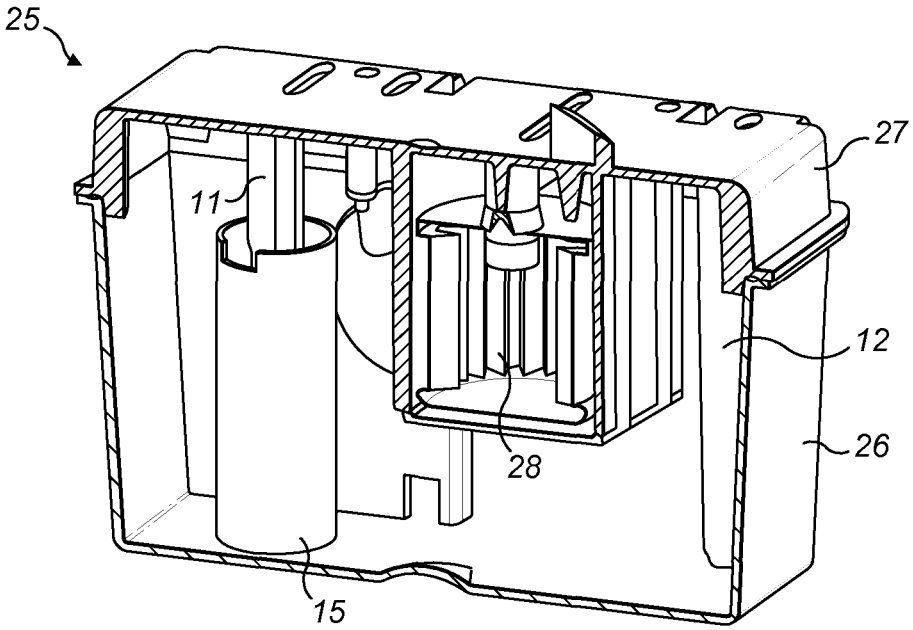
FIG. 5: shows a cross section of a service module for a continuous inkjet printer incorporating a working embodiment of that which is shown in FIG. 2.

The invention as described above is preferably incorporated into a replaceable ink module 25 as shown in cross-section in FIG. 5. This module is a service item and, as such, is detachable from both the print head and the ink circulation system of the printer.

In the form shown the module 25 comprises a moulded lid 27 sealingly fixed to a moulded body 26. The return line 11 and pick-up tube are moulded integrally with the lid 27 whilst the sub-chamber 15 is moulded integrally with the body 26. The lid also mounts a filter 28 which receives ink from the pick-up tube 12 and filters this ink before it is passed back into the ink circulation system. Connections (not shown) are provided on the rear side of the lid 27 to enable connection of the module into the printer's ink circulation system, at least some of the connections being in fluid engagement with the return line 11 and pick-up tube 12, respectively.

By incorporating the de-aeration facility into the module 25 the benefits of the invention can be obtained without modification to the main operating parts of the printer.

It will thus be appreciated that the invention, at least in the case of the embodiments herein described, provide an effective means of removing air from re-circulated ink in a continuous inkjet printer.

The invention claimed is:

1. A method of reducing foam formation in returned ink in a continuous inkjet printer, said printer having a returned ink receiving chamber maintained at atmospheric pressure; a returned ink delivery discharging into said chamber; and an ink pick-up leading from said chamber, wherein said method comprises:

directing said returned ink at greater than atmospheric pressure to said returned ink receiving chamber;

slowing the flowrate of returning ink by locating said returned ink delivery in a sub-chamber located within said chamber, wherein ink is fed into a lower region of said sub-chamber beneath a surface of ink in said sub-chamber and constraining the ink surface in said sub-chamber to rise and to overflow into said receiving chamber.

2. A method as claimed in claim 1 comprising slowing the rate of pressure change of said returned ink.

3. A method as claimed in claim 1 including reversing the direction of flow of the returning ink.

4. A method as claimed in claim 1 wherein said sub-chamber is cylindrical in cross section, said method comprising directing the returning ink downwardly into said sub-chamber in a direction substantially parallel to the axis of said sub-chamber.

5. A method as claimed in claim 1 comprising directing the overflowing ink from said sub-chamber on to a perforated surface.

6. A method as claimed in claim 1 comprising allowing the volume of ink within said sub-chamber to expand radially before overflowing into said receiving chamber.

7. A method as claimed in claim 1 when effected in a module located between, but detachable from, a print head and an ink circulation system.

8. A continuous inkjet printer comprising:

a returned ink receiving chamber maintained at atmospheric pressure;

a returned ink delivery discharging into said chamber; and an ink pickup leading from said receiving chamber, wherein said returned ink delivery is positioned in a lower region of a sub-chamber located within said receiving chamber so that ink discharged from said ink delivery enters said sub-chamber, at greater than atmospheric pressure and below an ink surface therein, and wherein an ink surface in said sub-chamber is constrained to rise and to overflow into said receiving chamber.

9. A continuous inkjet printer as claimed in claim 8 wherein said returned ink delivery is configured to reduce the rate of pressure change of the returned ink.

10. A continuous inkjet printer as claimed in claim 8 wherein said sub-chamber is constructed and arranged to reverse the direction of flow of the returning ink.

11. A continuous inkjet printer as claimed in claim 8 wherein said sub-chamber is cylindrical in cross section and said return pipe is aligned substantially parallel to the axis of said sub-chamber.

12. A continuous inkjet printer as claimed in claim 8 wherein said returned ink delivery further includes a perforated surface positioned to contact ink overflowing from said sub-chamber.

13. A continuous inkjet printer as claimed in claim 8 wherein said sub-chamber expands radially adjacent the upper end thereof.

14. A continuous inkjet printer as claimed in claim 8 wherein said receiving chamber and said sub-chamber are included in a module located between, but detachable from, a print head and an ink circulation system.

15. A service module for a continuous inkjet printer having an ink circulation system and a print head, said service module comprising:

an ink receiving chamber maintained at atmospheric pressure;

a returned ink delivery engageable with an ink return line from said print head; and an ink pick-up engageable with a pump supplying ink to said ink circulation system, wherein said returned ink delivery is positioned within a sub-chamber located within said ink receiving chamber so that ink is delivered to said sub-chamber at greater than atmospheric pressure and beneath an ink surface therein and wherein an ink surface in said sub-chamber is constrained to rise and overflow into said ink receiving chamber.

* * * * *